United States Patent [19]

Harvey

[11] 3,949,261

[45] Apr. 6, 1976

[54] DISPLAY PANEL

[75] Inventor: Edgar L. Harvey, Old Bridge, N.J.

[73] Assignee: Burroughs Corporation, Detroit, Mich.

[22] Filed: Feb. 24, 1975

[21] Appl. No.: 552,577

[52] U.S. Cl. ..... 313/188; 313/220

[51] Int. Cl.[2] ..... H01J 61/30

[58] Field of Search ..... 313/188, 220, 201

[56] References Cited

UNITED STATES PATENTS

| | | | |
|---|---|---|---|
| 3,626,235 | 12/1971 | Kupsky | 313/220 UX |
| 3,648,093 | 3/1972 | Kupsky | 313/220 X |
| 3,771,008 | 11/1973 | Chen et al. | 313/188 X |
| 3,784,864 | 1/1974 | Sasaki et al. | 313/220 X |

*Primary Examiner*—R. V. Rolinec
*Assistant Examiner*—Darwin R. Hostetter
*Attorney, Agent, or Firm*—Kevin R. Peterson; Robert A. Green; William B. Penn

[57] ABSTRACT

The display panel comprises a first insulating plate which carries a set of pins to which a first set of wires and other electrodes can be attached, and a second similar insulating plate having a set of pins to which a second set of wires and other electrodes can be secured. A set of cathodes is disposed between the two plates oriented at an angle to the first and second arrays of electrodes to form a dot matrix therewith. The cathodes are electrically connected to selected pins. One insulating plate is secured to the panel base plate to form one complete sub-assembly, and the other insulating plate is secured to the panel face plate to form another complete sub-assembly, and the two sub-assemblies are sealed together hermetically to form the completed panel.

7 Claims, 13 Drawing Figures

130
132
134
136
137
138
140
150
152
154
156
9

DISPLAY PANEL

BACKGROUND OF THE INVENTION

The present invention relates to panels of the type known as SELF-SCAN panels which are made and sold by Burroughs Corporation. SELF-SCAN panels include a slotted base plate in which anode wires are seated and on the top surface of which cathode strips are seated. The cathodes form a dot matrix of priming cells with the anode wires. An apertured insulating plate is seated on the cathodes, and the plate carries an array of cells disposed in rows and columns. Second anode wires are seated on the apertured plate, each aligned with a row of cells in the plate. These wires cooperate with the cathodes to form a dot matrix of display cells which are aligned with the priming cells. The cathodes are provided with tiny apertures, about 2 mils in diameter, each of which is disposed between a scanning cell and a display cell so that gas communication takes place between the two cells through such aperture. Thus, the panel includes a plurality of insulating plates and a plurality of sets of electrodes of small dimension, all of which must be assembled in critical and precise alignment. Panels of this type have been made successfully for several years; however, it can be seen that, with the number of sets of electrodes and the number of insulating plates which must be assembled in rather critical alignment, considerable care must be exercised to achieve such critical alignment.

Another problem area concerns the connection of the various panel electrodes to contact pins by which contact can be made to external circuit elements. Still another problem area relates to the mounting and support of the display panel in its surrounding environment. The present invention provides a display panel in which overall assembly, the making of electrode connections, the alignment of panel parts, the mounting of the panel in a surrounding environment are all simplified and improved.

SUMMARY OF THE INVENTION

Briefly, a display panel embodying the invention comprises first and second similar insulating plates to which various electrodes are secured to form sub-assemblies which can be readily sealed together to form a completed multi-layer display panel.

DESCRIPTION OF THE PREFERRED EMBODIMENTS

Figure 1:
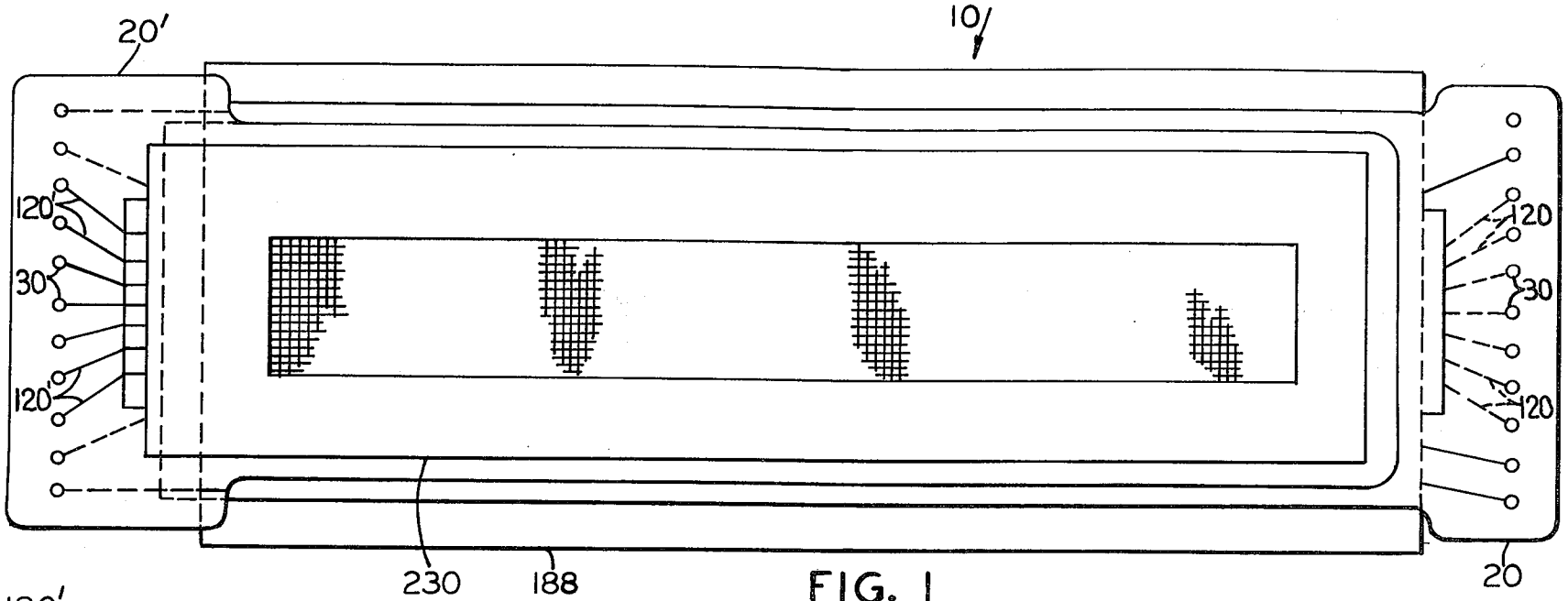
FIG. 1 is a plan view of a display panel embodying the invention.

A display panel 10 embodying the invention is made up of two sub-assemblies which are themselves relatively easily prepared and which can be assembled with relative ease to form the completed panel. One sub-assembly, called the scan sub-assembly, includes an insulating plate 20 of glass or the like, with a material known as Fotoform being preferred. The plate 20 has a top surface 22 and a bottom surface 24, and it carries a series of pins 30 disposed along and parallel to one edge, for example, the right-hand edge 40, as seen in FIG. 1. The greater portion of the pins 30 lies beneath the bottom surface 24 of the plate 20. A plurality of wire guide notches 50 are formed along the opposite edge 60 of the plate 20. A comb-like wire guide member 70 is secured to or is formed on the plate 20 and comprises a generally rectangular elongated insulating body disposed parallel to and adjacent to the row of pins 30 and having a plurality of notches 80 cut in its top surface for receiving and guiding electrode wires to the pins 30.

The plate 20 is also provided with three cathode receiving slots 81, 82, 83 disposed parallel to each other adjacent to the upper edge 90 of the plate 20 and three similar slots 81′, 82′, 83′ disposed parallel to each other adjacent to the lower edge 100 of the plate. Between these upper and lower slots are provided a plurality of parallel scanning or priming cell slots 102 which are aligned with the notches 50. If panel 10 is to display characters by means of 5 × 7 dot matrices, then seven slots 102 are provided. Two auxiliary slots 103 are also provided above and below the array of slots 102 for a purpose to be described. Four apertures 106, 107, 108, 109 are provided in the plate adjacent to the left-hand end thereof, and six other cathode locking apertures are provided near the center of the plate, three, 110, 111, 112, between the upper cathode slot 83 and the upper auxiliary slot 103, and three 110′, 111′, 112′, between the lower cathode slot 83′ and the lower auxiliary slot 103′.

Figure 2:
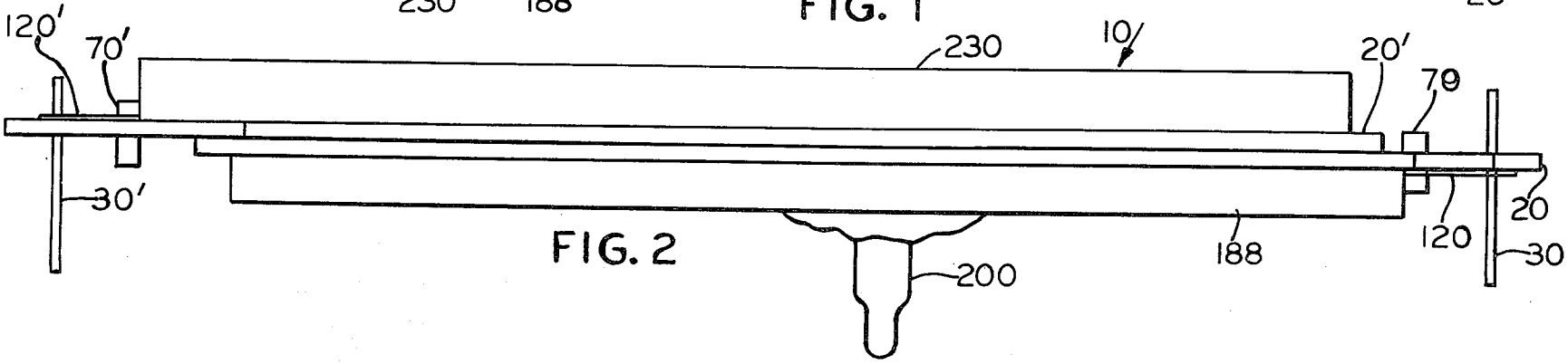
FIG. 2 is a side elevational view of the panel of FIG. 1.

To form the first sub-assembly, the plate 20 is secured to a fixture known as a harp (not shown), and anode wires 120 are stretched from end to end of the harp, across plate 20 and along bottom surface 24 thereof, each engaging a notch 50 and extending along a slot 102 and along a notch 80 in the guide member 70 and then engaging a pin 30. The wires 120 are secured to the plate 20 by means of a glass frit such as Pyroceram which is applied to the wires in the notches 50 at the edge of the plate and on the member 70 and at the pins 30 to secure the wires to these members. After the wires 120 are secured in place, the assembly is cut away from the mounting fixture, and the scan sub-assembly appears as shown in FIG. 2.

Figure 3:
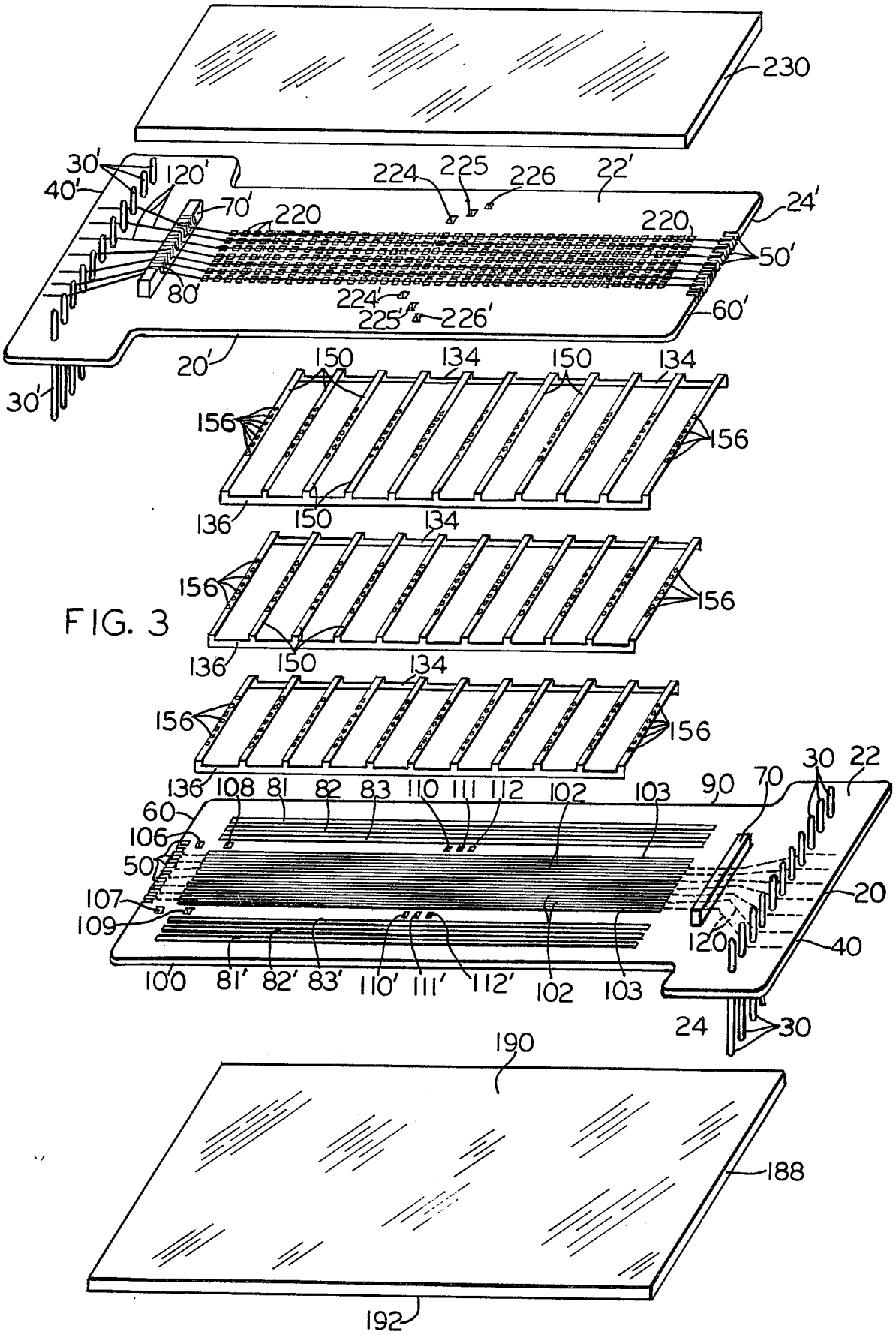
FIG. 3 is an exploded perspective view of the panel of FIG. 1.

Next, the cathodes 150 of the panel 10 are secured to the scan sub-assembly. As is well know, SELF-SCAN panels usually use, but are not required to use, three groups of cathodes, and three groups of cathodes are shown and described herein. The groups of cathodes are substantially identical except that the cathodes of each group are of a different length so that the ends of each group can be seated in one of the slots 81, 82, or 83. Each group of cathodes, a portion of one of which is shown in FIG. 3, is formed initially, for example, by a photo-etching process, as a unitary assembly comprising a frame 130 having filamentary connections 132 to upper and lower horizontal conductors 134 and 136, to which are secured the upper and lower ends of the vertical cathode strips 150. One cathode of each group is also provided with portions which can be bent out to form pairs of locking tabs 152 (FIG. 4) for insertion in one of the pairs of apertures 110, 110′, or 111, 111′, or 112, 112′. The same or other cathodes are also provided with pairs of tabs 154 which are adapted to engage and lock with a display cell plate to be described.

Figure 4:
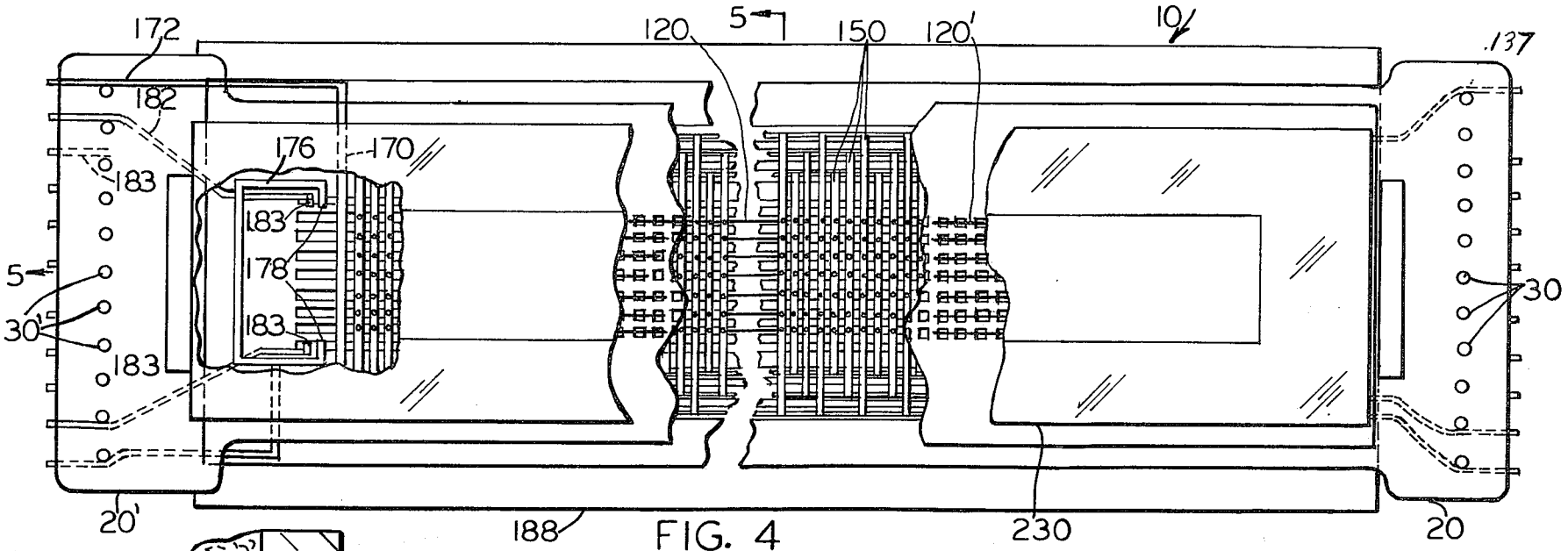
FIG. 4 is a plan view, partially cut away, of the panel of FIG. 3 when assembled.
Figure 5:
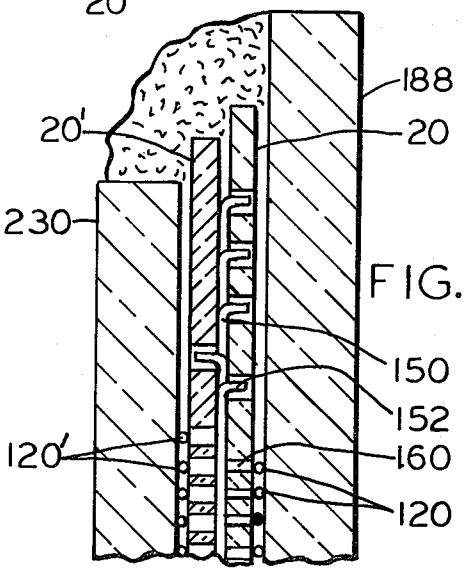
FIG. 5 is a sectional view along the lines 5—5 in FIG. 4.
Figure 6:
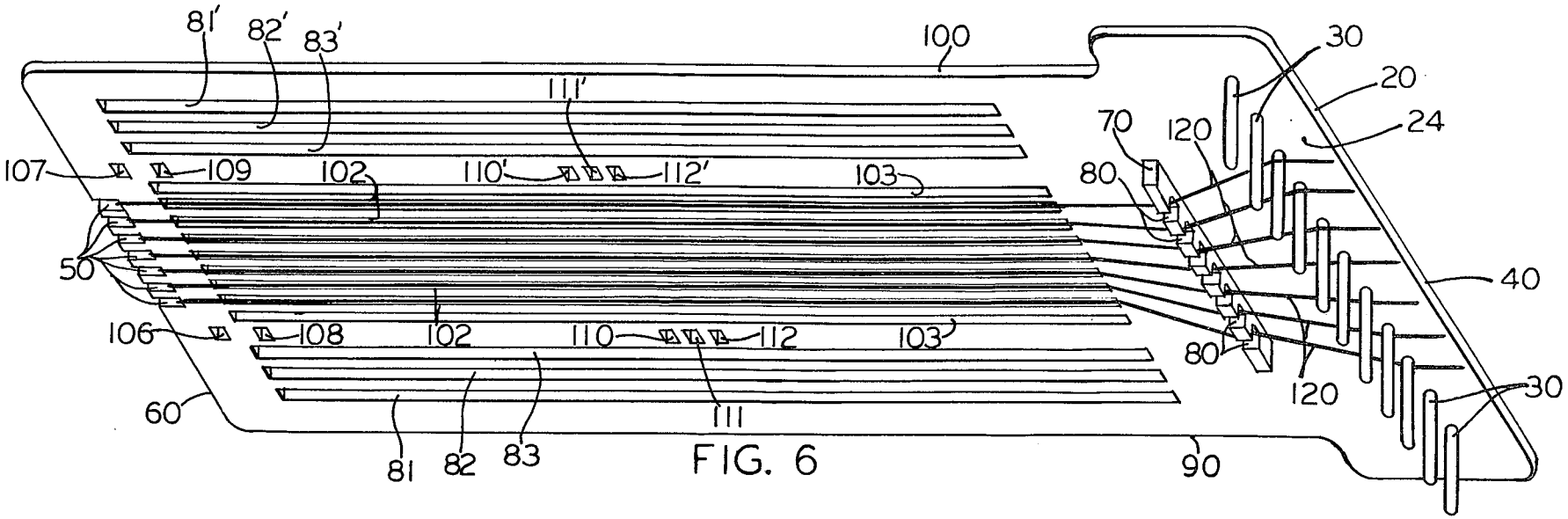
FIG. 6 is a perspective view of the lower surface of a portion of the panel of FIG. 1.
Figure 7:
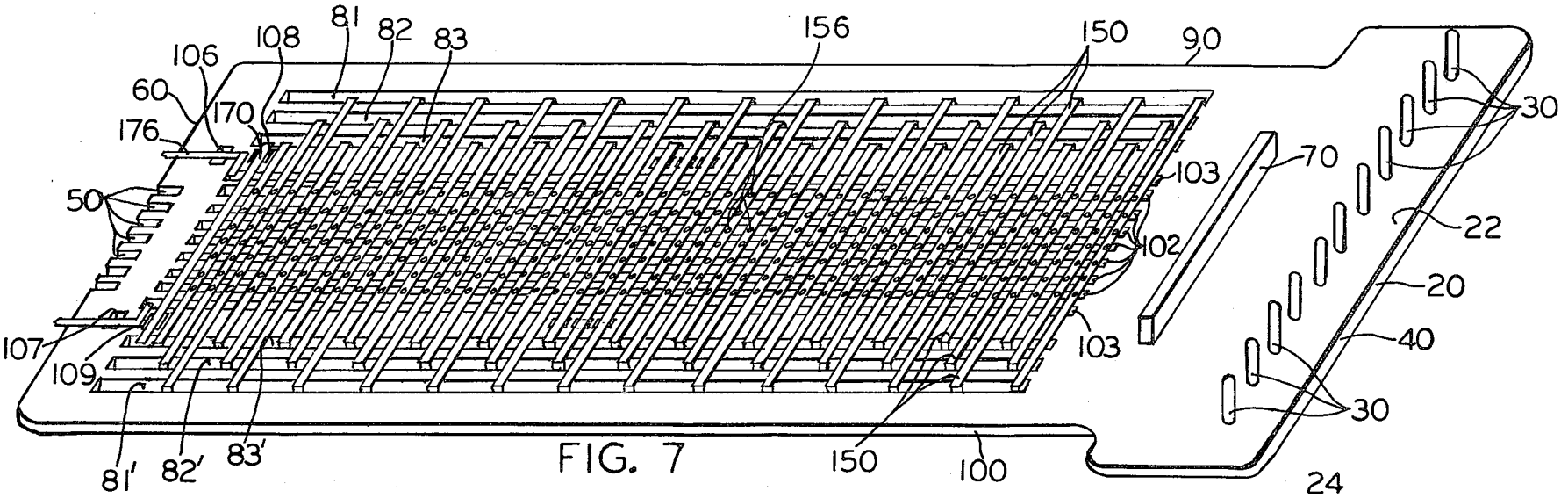
FIG. 7 is a perspective view of the upper surface of the panel-portion of FIG. 6.
Figures 8, 9, 10:
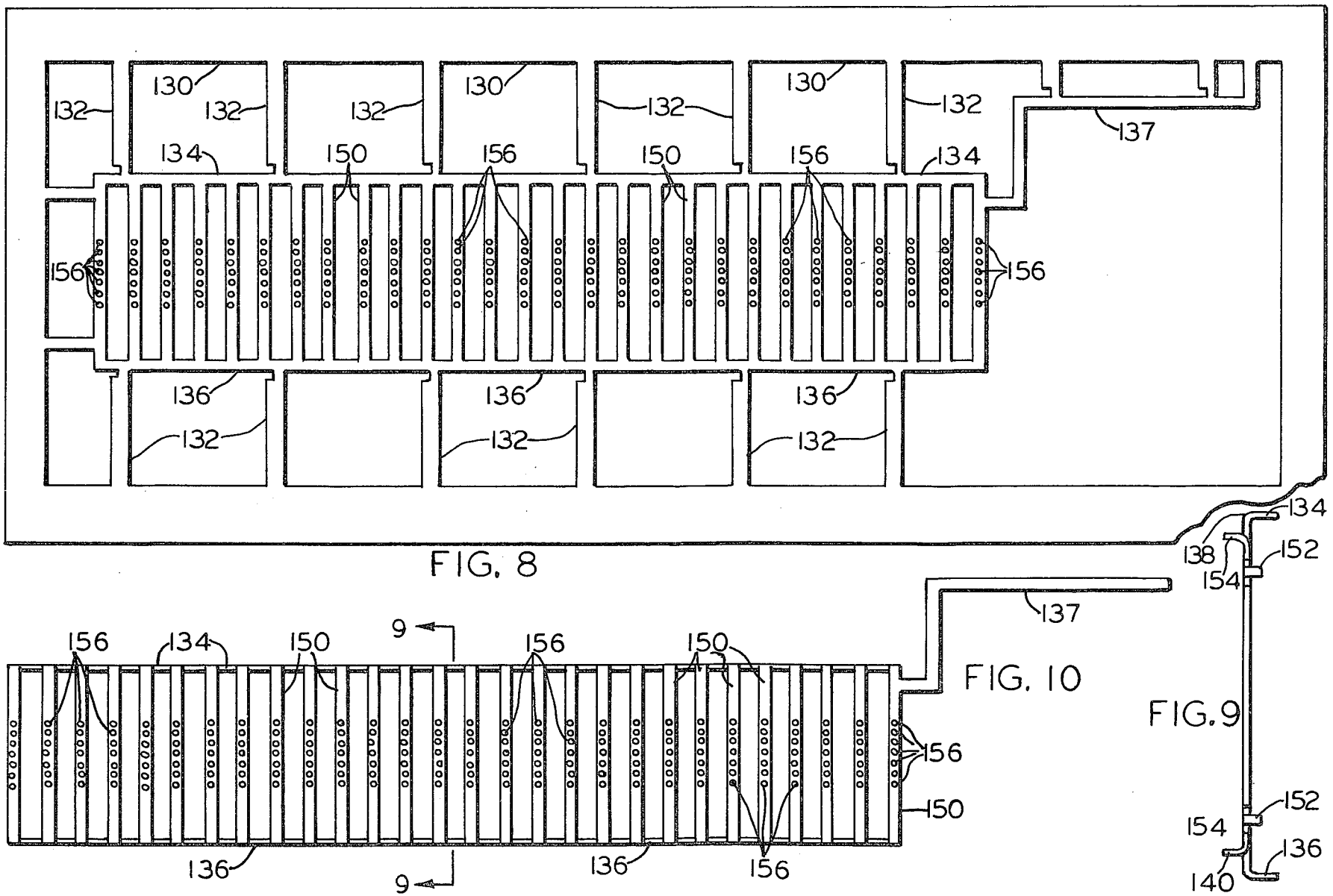
FIG. 8 is a plan view of a cathode assembly used in the panel of FIG. 1.
FIG. 9 is a sectional view along the lines 9—9 in FIG. 10.
FIG. 10 is a plan view of the cathode assembly of FIG. 8 as it appears when ready for assembly with other parts of a panel.
Figure 11:
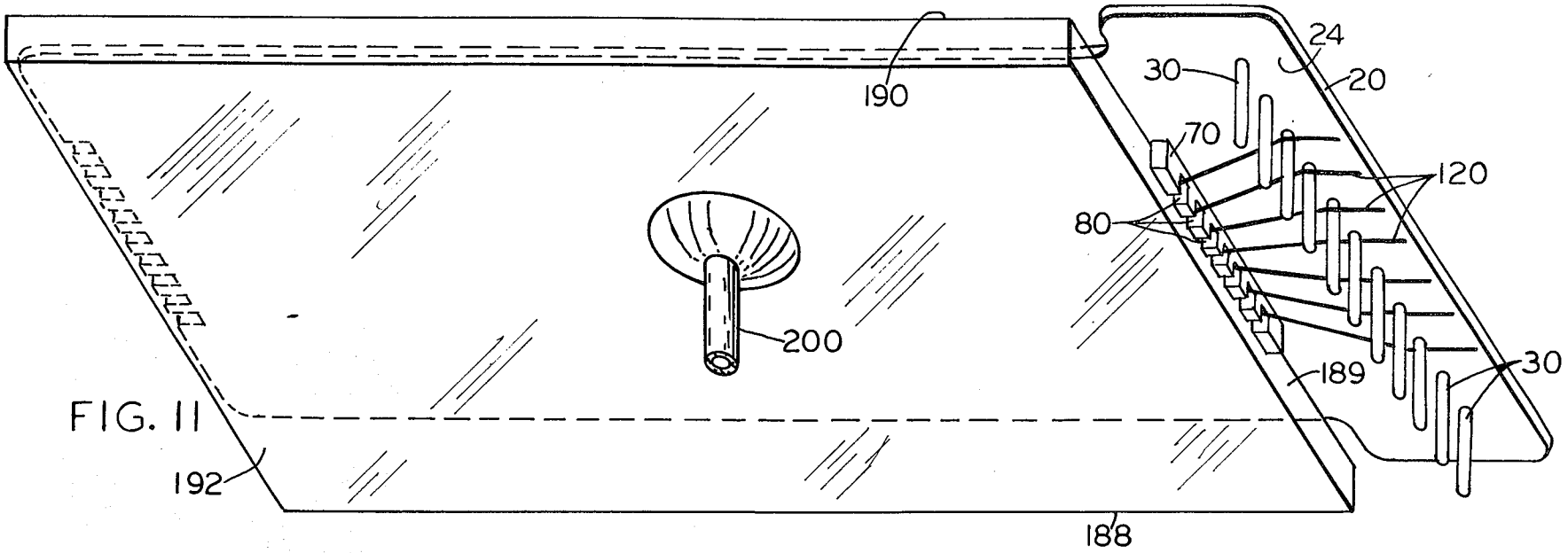
FIG. 11 is a perspective view of the lower surface of one sub-assembly of the panel of FIG. 1.

To mount each group of cathodes on scan plate 20, as shown in FIGS. 4 and 5, the frame 130 and filaments 132 are removed, the upper and lower common conductors 134 and 136, and the tabs 152 are also bent downwardly. Tabs 154 are bent upwardly. Each group of cathodes is placed on the top surface 22 of plate 20 with tabs 152 in the appropriate set of holes 110, 110′, 111, 111′, or 112, 112′, and with its bent upper and lower ends and the upper and lower conductors seated in one pair of the slots 81, 81′, or 82, 82′, or 83, 83′, (FIGS. 4 and 7). Thus, one set of cathodes has its ends and conductors seated in the outermost of the upper and lower slots 81 and 81′ in the plate 20, a second set has its ends and common conductors seated in the center slots 82 and 82′, and the third set has its ends and common conductors seated in the innermost slots 83 and 83′. The downwardly projecting tabs 152 seated in the apertures 110, 110′, or 111, 111′, or 112, 112′, prevent the assembly of cathodes from shifting in the horizontal direction, and the seating of the ends of the cathodes and conductors 134 and 136 in the slots 81, 81′, 82, 82′, 83, 83′, prevent the movement of the cathodes in the vertical direction. After the cathodes have been thus seated in place, one of the common conductors of each (134 or 136) is welded, by a suitable extension thereof 137, to one of the pins 30, as shown in FIG. 4.

The cathode strips are each provided with a series of holes 156, equal in number of anode wires, that is seven, with each hole generally overlaying a cell slot 102. To simplify the drawing, holes 156 are not shown in each cathode.

The lower surfaces of the cathodes 150 and the portions of the scan anodes 120 beneath them define scanning or priming cells 160, and all of the cathodes and scan anodes define a matrix of rows and columns of such scanning cells.

A reset cathode strip 170, which does not have apertures, is positioned to the left of and adjacent to the first apertured cathode strip 150 and is secured in place by means of tabs (not shown) inserted in apertures 108 and 109 in plate 20. The reset cathode has a lead 172 which is welded to a pin on a second plate similar to plate 20, to be described below. The reset cathode and the scan anode wires define a column of reset cells 174. Reset cathode structure and function are described and claimed in U.S. Pat. No. 3,767,968.

A keep-alive electrode assembly is secured to plate 20, and this assembly includes a generally C-shaped keep-alive cathode 176 having end portion 178 disposed over each of the slots 103. The keep-alive cathode is secured by tabs (not shown) to the apertures 106 and 107 in plate 20, and it has a lead 182 which, like reset cathode 170, is secured to a pin on a plate to be described. The keep-alive electrode assembly also includes two small plate-like keep-alive anode electrodes 183 positioned over and bent into the left-hand ends of slots 103 close to the ends 178 of the keep-alive cathode 176. The keep-alive anodes have connecting lead portions 183 secured to pins on a plate to be described. Each keep-alive cathode and its associated keep-alive anode form a keep-alive cell.

The scan plate 20 is secured to a glass plate 188, which comprises the base plate of the panel, and has a top surface 190 and a bottom surface 192. An exhaust-fill tubulation 200 is secured to the bottom surface of the base plate in alignment with a hole in the base plate. The plate 20 is seated on the top surface of the base plate with its surface 24 and anode wires 120 seated on the base plate, and the two plates are secured together by means of a glass frit or the like deposited along the adjacent ends of the two plates. Preferably, plate 188 is set in place with its end 189 bearing against wire guide member 70, as shown in FIG. 2. The scan sub-assembly is thus completed.

The display panel 10 includes a second sub-assembly, called the display sub-assembly, which includes an insulating plate 20′ of glass or the like which is substantially identical to plate 20 in size and shape and in some of its adjuncts. Similar parts in the two plates are given the same reference numeral, the parts in the second plate carrying primed numerals. Plate 20′ has a series of pins 30′ disposed along and parallel to one edge, for example, the left-hand edge 40′, as seen in FIGS. 2 and 3, with the greater portion of the length of the pins extending beneath the top surface 24′ of plate 20′, as seen in FIG. 2. A plurality of wire guide notches 50′ are formed along the opposite edge 60′ of the plate 20′. Plate 20′ carries a wire guide member 70′, adjacent to pins 30′, which has notches 80′ cut in its top surface for receiving electrode wires.

The plate 20′ is provided with a plurality of apertures 220 arrayed in rows and columns and comprising display cells in the completed panel 10. The apertures or cells 220 are of a size suitable for operation as display cells. In the completed panel, the rows of cells 220 (seven in number) are generally aligned with the rows of cathode apertures 156 and with the slots 120 in plate 20. The columns of cells 220 are generally aligned with the columns of cathode apertures. Thus, the rows and columns of display apertures 220 are generally aligned with the rows and columns of cathode apertures 156 and with the rows and columns of scanning or priming cells. Plate 20′ also has three pairs of apertures 224 and 224′, 225 and 225′, and 226 and 226′ disposed above and below the array of cells 220. Each such pair of apertures receives a pair of tabs 154 of one set of cathodes 150.

Figure 13:
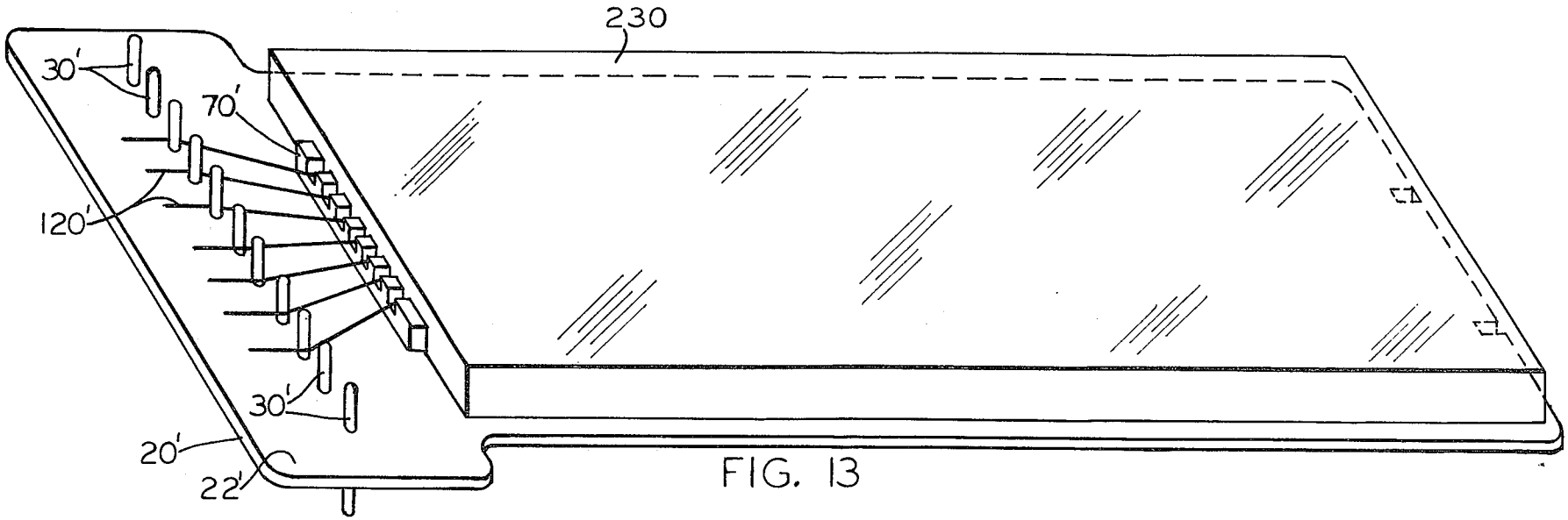
Figure 12:
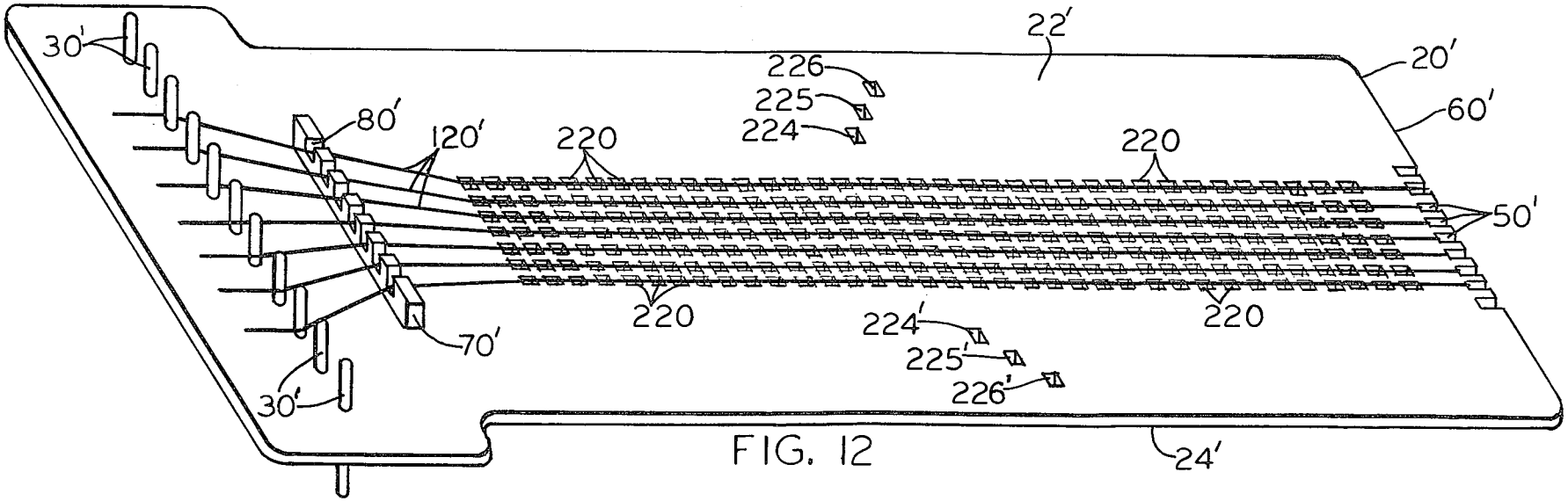
FIG. 12 is a perspective view of the top surface of another portion of the panel of FIG. 1; and FIG.. 13 is a perspective view of another sub-assembly used in the panel of FIG. 1.

To form the second sub-assembly, the plate 20′ is secured to a fixture (not shown), and display anode wires 120′ are stretched from end to end of the fixture, across surface 22′ of plate 20′, and preferably in shallow depressions 28 therein, each wire engaging a notch 50′ and extending along a row of cells 220 and along a notch in the guide member 70′ and then engaging a pin 30′. The wires 120′ are secured in place with a glass frit, just as the wires 120 are secured. After the wires 120′ are secured in place, the assembly is cut away from the mounting fixture, and the display sub-assembly appears as shown in FIGS. 12 and 13. The anode wires 120' and the top surfaces of the cathodes 150 beneath them comprise the electrodes for the display cells 220.

Next, the display sub-assembly is secured to a glass plate 230 which comprises the face plate of the completed panel. The plate 20' is positioned with surface 22 and anode wires adjacent to the bottom surface of the face plate 230, with the end 234 of the face plate butting against wire guide member 70, and the adjacent end portions are secured together by a glass frit 240.

The display sub-assembly is now completed, and the two sub-assemblies are ready for final assembly to form panel 10. The final panel is formed by coupling together the two sub-assemblies so that the bottom surface 24' of plate 20' is seated on the cathodes which are coupled to the scan plate 20, with the pairs of tabs 154 on the three sets of cathodes inserted in the pairs of apertures 224 and 224', 225 and 225', and 226 and 226' in plate 20'. With the two sub-assemblies thus positioned, the greater portion of all of the pins 30 and 30' extend in the same direction beneath the panel.

With the two sub-assemblies thus coupled together, a suitable sealing material such as a glass frit is placed around the adjacent perimeters of the two sub-assemblies, and the panel is heated to properly cure the frit and to form the desired hermetic seal. Next, the panel is processed in accordance with any suitable required procedure, for example, by baking out through the exhaust tubulation, filling with the desired gas through the tubulation, sealing off the tubulation, and suitably aging the panel.

The panel 10 is operated like any SELF-SCAN panel as described, for example, in U.S. Pat. No. 3,821,586 and in copending application Ser. No. 487,955, filed July 12, 1974. Briefly, such operation comprises energizing the columns of scanning or priming cells sequentially, and, as each column is energized, simultaneously applying information signals to selected display anodes 120' whereby glow is transferred from a scanning cell to the selected energized display cell 220 above it. As the panel is thus scanned and operated, the display cells which are energized and caused to glow display an apparently stationary but changeable message.

What is claimed is:

1. A display panel comprising a gas-filled envelope comprising a base plate and a face plate having a viewing window including a first insulating plate having a plurality of parallel slots extending along its length, a plurality of first contact pins secured to said first plate and extending transversely adjacent to an edge thereof, said pins lying outside said envelope, a plurality of first electrodes secured between each of said pins and the opposite end of said first plate, each such electrode extending along one of said slots, said electrodes lying between the lower surface of said plate and the base plate of said envelope, a plurality of second strip-like electrodes disposed parallel to each other on the top surface of said first plate and oriented at 90° to said first electrodes, each of said second electrodes including an array of holes extending along its length, with each hole overlying one of said slots in said first plate, each crossing of a second electrode and a first electrode defining a priming cell, a second insulating plate having an array of rows and columns of display apertures overlying said second electrodes and said first plate, with each aperture therein generally aligned with a hole in a second electrode, a plurality of second contact pins secured to said second plate and extending transversely adjacent to an edge thereof, said pins lying outside said envelope, said first and second pins being positioned at opposite ends of said envelope, and a plurality of third electrodes secured between each of said second pins and the opposite end of said second plate, and extending across the top surface of said second plate and spaced from said second electrodes by said second plate, each third electrode being parallel to a corresponding first electrode positioned beneath it and aligned with a row of said apertures, each third electrode crossing said second electrodes at 90° and each such crossing forming a display cell, said face plate overlying said second insulating plate and said third electrodes and hermetically sealed to said base plate and said first and second insulating plates.

2. A display panel comprising a gas-filled envelope comprising a base plate and a face plate having a viewing window, a first insulating plate having a plurality of first apertures extending along its length, and usable as gas cells, a plurality of first contact pins secured to said first plate and extending transversely adjacent to an edge thereof, said pins lying outside said envelope, a plurality of first electrodes secured between each of said pins and the opposite end of said first plate and disposed between the lower surface of said first plate and the base plate of said envelope, a plurality of second strip-like electrodes disposed parallel to each other on the top surface of said first plate and oriented at 90° to said first electrodes, said second electrodes facing said first electrodes, through said first apertures, each of said second electrodes including an array of holes extending along its length, with each hole overlying one of said apertures in said first plate, each crossing of a second electrode and a first electrode defining a priming cell, a second insulating plate having a plurality of second apertures extending along its length and usable as gas cells overlying said second electrodes and said first plate, with said second apertures being aligned with said holes in said second electrodes, a plurality of second contact pins secured to said second plate and extending transversely adjacent to an edge thereof, said pins lying outside said envelope, said first and second pins being positioned at opposite ends of said envelope, and a plurality of third electrodes secured between each of said second pins and the opposite end of said second plate, and extending across the top surface of said second plate and spaced from said second electrodes by said second plate, each third electrode being parallel to a corresponding first electrode positioned beneath it and aligned with selected ones of said second apertures, each third electrode crossing said second electrodes at 90° and each such crossing forming a display cell, said face plate overlying said second insulating plate and said third electrodes and hermetically sealed to said base plate and said first and second insulating plates.

3. The display panel of claim 2 wherein said first electrodes and said second electrodes are operable as anodes and cathodes, respectively, for their gas cells, and said third electrodes and said second electrodes are operable as anodes and cathodes, respectively, for their gas cells.

4. The display panel of claim 2 wherein said second electrodes comprise cathodes and said first and third electrodes comprise anodes.

5. The display panel of claim 2 wherein said first and third electrodes are disposed generally parallel to each other and said second electrodes are oriented at an angle thereto so that said second electrodes cross said first and third electrodes at said gas cells.

6. The panel of claim 2 wherein said priming cells and said display cells are arrayed in rows and columns, with each first cell being in gas communication with a second cell.

7. The panel of claim 6 wherein said priming cells and display cells are in gas communication through said holes in said second electrodes.

* * * * *